United States Patent [19]

Nobakht

[11] Patent Number: 4,902,060

[45] Date of Patent: Feb. 20, 1990

[54] DETACHABLE BAG-CARRYING HANDGRIP DEVICE

[76] Inventor: Jamshid Nobakht, 6800 MacDonald Avenue, Montreal, Quebec, Canada, H3X 3Z2

[21] Appl. No.: 309,483

[22] Filed: Feb. 13, 1989

[51] Int. Cl.[4] ..... A45F 5/10

[52] U.S. Cl. ..... 294/171; 16/114 B

[58] Field of Search ..... 16/114 R, 114 B, 119; 294/171, 170, 137

[56] References Cited

U.S. PATENT DOCUMENTS

| | | | |
|---|---|---|---|
| 645,670 | 3/1900 | Ottignon | 294/171 |
| 1,268,775 | 4/1917 | Stanger . | |
| 1,576,546 | 2/1925 | Ransom . | |
| 2,441,531 | 5/1948 | Gese | 294/170 |
| 2,448,894 | 9/1948 | Laus | 16/114 B |
| 2,519,186 | 4/1949 | Herbert et al. . | |
| 3,083,366 | 3/1963 | Mitrovacki Franges . | |
| 4,590,640 | 5/1986 | Enersen . | |

FOREIGN PATENT DOCUMENTS

| | | |
|---|---|---|
| 2132079 | 7/1984 | United Kingdom . |
| 2147200 | 5/1985 | United Kingdom . |
| 2153213 | 8/1985 | United Kingdom . |

*Primary Examiner*—Nicholas P. Godici
*Assistant Examiner*—Carmine Cuda

[57] ABSTRACT

A detachable bag-carrying handgrip device for hand-carrying one or more bags by their handle portion. The handgrip portion comprising an elongated handle member defined by integrally formed outwardly extending side walls merging in a bottom trough section. The handle member has an open top end for receiving a bag handle portion. A pair of retaining flanges are provided at opposed ends of the handle member and have a slot therein leading to an enlarged aperture capable of accommodating one or more of the bag handle portions passing therethrough. The enlarged aperture extends into an end portion of the bottom trough section and defines a curved end wall.

6 Claims, 1 Drawing Sheet

DETACHABLE BAG-CARRYING HANDGRIP DEVICE

BACKGROUND OF INVENTION

1. Field of Invention

The present invention relates to an improved detachable bag-carrying hand-gripping device capable of carrying one or more bags by their handle portion.

2. Description of Prior Art

Various bag-carrying handle grips are known. For example, reference is made to U.S. Pat. No. 1,576,546 which shows such a handgrip device formed or molded to have a straight or an arcuate configuration. As herein shown, the handgrip fits onto a string to support a bag or a package. It is also known to provide these handgrip devices for carrying plastic bags, such as shown in British Patent No. 2,147,200 and wherein the handgrip is fitted through the handle hole of the plastic bags. It is this latter type of handgrip that the present invention has improved upon.

A disadvantage of some of the handlegrips of the prior art is that these can be fitted to carry a single article or bag. Also, some of the handles are easily detached from the bag or the article when the article is not supported, that is to say, when there is no tension or load on the handgrip by the article or the bag. Still further, with prior art devices the strings or handgrip portions of the bags wear out the ends of the handgrip thus sharpening the end edge which in turn damages and often can sever the string or bag handle to cause it to detach and fall to the ground and damage some of the contents that may be contained therein.

Other known types of handgrip devices, such as that disclosed in U.S. Pat. No. 1,268,775, are formed from rigid material and can only be fitted on specific shape handles, such as a curved bail of a bucket. A still further disadvantage is that some of these handgrip devices are easily detachable from the handgrip portion of bags, and can cause the bag to slip out again damaging its contents.

SUMMARY OF INVENTION

It is a feature of the present invention to provide an improved detachable bag-carrying handgrip device which substantially overcomes all of the above-mentioned disadvantages of the prior art.

Another feature of the present invention is to provide a detachable bag-carrying handgrip device having an improved bag attaching means to positively engage with one or more bag-carrying handles.

According to the above features, from a broad aspect, the present invention provides a detachable bag-carrying handgrip device for hand-carrying one or more bags by their handle portion. The handgrip portion comprises an elongated handle member defined by integrally formed outwardly extending side walls merging in a bottom trough section. The handle member has an open top end for receiving a bag handle portion. A pair of retaining flanges are provided at opposed ends of the handle member and have a slot therein leading to an enlarged aperture capable of accommodating one or more of the bag handle portions passing therethrough. The enlarged aperture extends into an end portion of the bottom trough section and defines a curved end wall.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
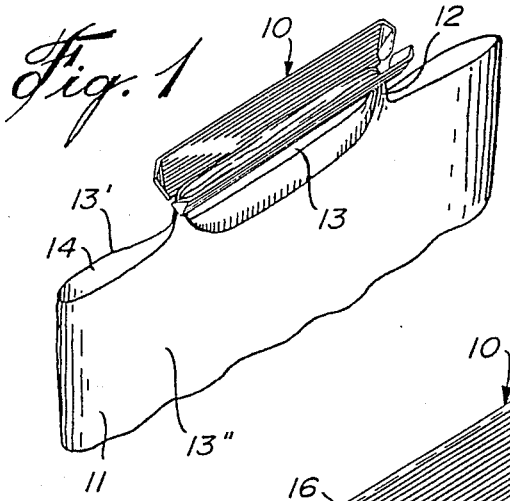
FIG. 1 is a perspective view showing the detachable bag-carrying handgrip of the present invention as secured to a plastic bag.
Figure 2:
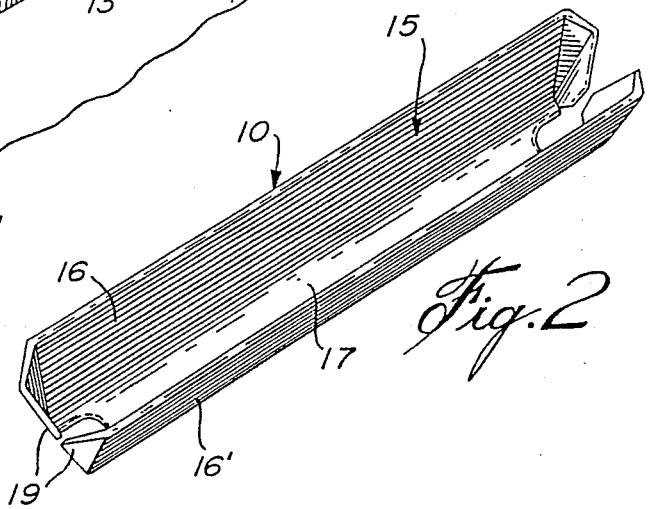
FIG. 2 is an enlarged perspective view of the detachable bag-carrying handgrip device of the present invention.

Referring now to the drawings, and more particularly to FIG. 1, there is shown the detachable bag-carrying handgrip device 10 of the present invention as secured to a plastic bag 11, and more specifically to the band portion 12 formed above the handle hole 13 in the opposed side walls 13' and 13'' of the bag adjacent the top open end 14.

Referring now additionally to FIGS. 2 to 5, the detachable bag-carrying handgrip device as herein shown is molded from a flexible plastics material and has a wall thickness whereby to provide such flexibility. The handgrip device comprises an elongated handle member 15 having integrally formed opposed outwardly extending side walls 16 and 16' merging in a bottom trough section 17. The handle member also defines an open top end 18 for receiving the bag handle portion 12 therethrough.

A pair of retaining flanges 19 are provided at opposed ends of the handle member and molded integrally therewith. These retaining flanges extend inwardly towards the central longitudinal axis 20 of the handle member (see FIG. 5) and define an open-ended funnel-shape gap 21 in a top end thereof which merges into the top end of a narrow slot 22. The funnel-shape gap is provided to guide the bag handle portion and eliminate sharp edges to facilitate installation onto the bag handle.

Figure 3:
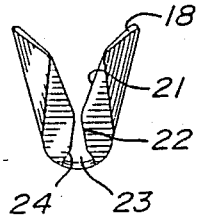
FIG. 3 is an end view of FIG. 1.
Figure 4:
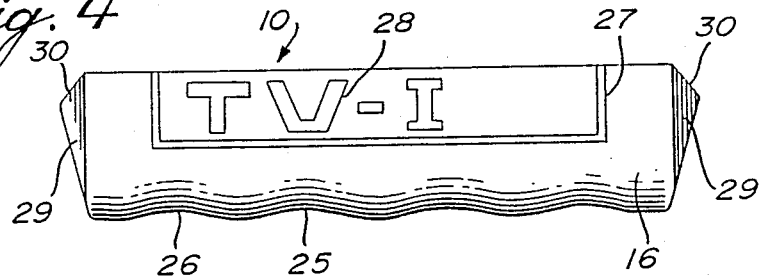
FIG. 4 is a side view of FIG. 1.
Figure 5:
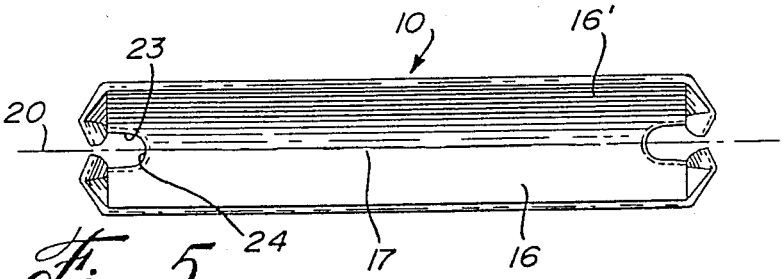
FIG. 5 is a top ivew of FIG. 1.

As shown more clearly in FIGS. 3 and 5, the slot bottom end leads into an enlarged aperture 23 capable of accommodating therethrough one or more of the bag handle portions. This enlarged aperture 23 extends into an end portion of the bottom trough section and is of generally rectangular shape therein and terminates in a curved end wall 24. The importance of the curved end wall is that the bag handle portion which often moves on the edge of the slot does not rest against a straight sharp edge which could sever the bag portion, particularly the string-like handle portion. Therefore, the aperture has the advantage of accommodating several bag handles and protects the bags from being damaged. The restricted slot opening 22 prevents the bags from being detached so that the handle will be retained on the bag handle when the bags are rested on a surface. Also, the aperture 23 extends into the bottom where the bag handles are accommodated and are not squeezed to press against the flanges but instead are captivated by the flanges and the adjacent end portions of the side walls 16 and 16'.

As can be seen from FIGS. 1, 3 and 5, the bottom end of the slot also has tapered edges 24 which leads to the aperture 23. These tapered edges also facilitate the removal of the bag handle portions when the handlegrip is detached therefrom.

The outer face of the bottom section 25 of the handgrip device may also be provided with finger-grip formations 26 to provide more comfort to the user. Still further, the outer face of each of the side walls 16 and 16' may be provided with a delineated area 27 which may be embossed or cavitated to provide thereon printed material, or may carry molded printed matter 28. As also more clearly shown in FIG. 4, the ends of the handle member may have a tapered and outwardly extending end wall portion 29 with a downwardly tapered upper edge 30 to facilitate guiding the bags into the slot and to also strengthen the end flanges as well as facilitating the molding of the handgrip device. They also serve to captivate the handle portion. The outwardly tapered side walls 16 and 16', and end wall portions 29 also permit the handgrip device to be stacked one into the other for convenience in packing, shipping and storing.

It is within the ambit of the present invention to cover any obvious modifications of the preferred embodiment described herein, provided such modifications fall within the scope of the appended claims.

I claim:

1. A detachable bag-carrying handgrip device for hand-carrying one or more bags having flexible handle portions, said handgrip device comprising an elongated handle member defined by integrally formed opposed outwardly extending thin flexible rectangular side walls merging in a bottom trough section, said handle member having an open top end for receiving a bag handle portion, an end wall at opposed ends of said side walls and defined by a pair of retaining flanges at opposed ends of said side walls and having a slot defined therebetween leading to an enlarged aperture capable of accommodating one or more of said bag handle portions passing therethrough, said enlarged aperture extending into an end portion of said bottom trough section and defining a curved end wall, each said retaining flanges having an outwardly tapered bottom end wall section, said pair of flanges defining a funnel-shape gap therebetween, each said flange also defining a strengthening portion extending angularly inwards from a top end thereof and having a sloped upper edge merging into a respective side of said funnel-shape gap to guide said flexible handle portion into said gap and to strengthen said end wall.

2. A handgrip device as claimed in claim 1 wherein said enlarged aperture is substantially rectangular in said end portion of said bottom trough and terminates in an arcuate end edge.

3. A handgrip device as claimed in claim 1 wherein said handle member is molded from plastics material.

4. A handgrip device as claimed in claim 3 wherein an outer face of said trough section is provided with molded finger grips.

5. A handgrip device as claimed in claim 3 wherein an outer face of each said side walls are provided with a delineated area for the insertion of printed material.

6. A handgrip device as claimed in claim 5 wherein an outer face of each said side walls are provided with an insertion of molded printed matter.

* * * * *